US007543923B2

(12) United States Patent
McNestry

(10) Patent No.: US 7,543,923 B2
(45) Date of Patent: Jun. 9, 2009

(54) LIQUID SUPPLY SYSTEM

(75) Inventor: Martin McNestry, Derby (GB)

(73) Assignee: Zipher Limited, Nottingham (GB)

( * ) Notice: Subject to any disclaimer, the term of this patent is extended or adjusted under 35 U.S.C. 154(b) by 438 days.

(21) Appl. No.: 10/593,551

(22) PCT Filed: Mar. 18, 2005

(86) PCT No.: PCT/GB2005/001138

§ 371 (c)(1),
(2), (4) Date: Sep. 19, 2006

(87) PCT Pub. No.: WO2005/090085

PCT Pub. Date: Sep. 29, 2005

(65) Prior Publication Data

US 2007/0195144 A1 Aug. 23, 2007

(30) Foreign Application Priority Data

Mar. 19, 2004 (GB) ..... 0406197.4

(51) Int. Cl.
*B41J 2/175* (2006.01)

(52) U.S. Cl. ..... 347/85

(58) Field of Classification Search ..... 347/7, 347/84, 85; 141/2, 18

See application file for complete search history.

(56) References Cited

U.S. PATENT DOCUMENTS

| | | | | |
|---|---|---|---|---|
| 4,383,263 | A * | 5/1983 | Ozawa et al. | 347/30 |
| 5,343,226 | A | 8/1994 | Niedermeyeyr et al. | |
| 5,446,486 | A * | 8/1995 | Reis | 347/85 |
| 5,701,149 | A | 12/1997 | Pagnon et al. | |
| 5,774,154 | A | 6/1998 | Underwood | |
| 5,801,735 | A | 9/1998 | Lorenze, Jr. et al. | |
| 5,886,718 | A * | 3/1999 | Johnson et al. | 347/85 |
| 6,663,233 | B2 * | 12/2003 | Otsuka et al. | 347/85 |
| 2003/0025773 | A1 | 2/2003 | Koizumi et al. | |

FOREIGN PATENT DOCUMENTS

| | | |
|---|---|---|
| EP | 0 322 131 | 6/1989 |
| EP | 0 921 055 | 3/2001 |
| GB | 2 304 639 | 3/1997 |

* cited by examiner

*Primary Examiner*—Anh T. N. Vo
(74) *Attorney, Agent, or Firm*—Nixon & Vanderhye P.C.

(57) ABSTRACT

A liquid supply system comprising a liquid reservoir and a liquid container for supplying liquid to the reservoir. Connection means connects the reservoir to a position within the container that is immersed in the contained liquid. Means for alternately pressurising and depressurising the reservoir are provided. The arrangement is such that when the reservoir is pressurised gas is forced into the container through the connection means and accumulates above the liquid in the container. When the reservoir is depressurised accumulated gas in the container forces liquid through the connection means to the reservoir.

38 Claims, 6 Drawing Sheets

LIQUID SUPPLY SYSTEM

CROSS-REFERENCE TO RELATED APPLICATION

The present application is the national stage of the International Patent Application PCT/GB2005/001138 filed Mar. 18, 2005, the contents of which are hereby incorporated herein by reference in its entirety.

The present invention relates to inkjet printers and to liquid supply systems, i.e. systems in which liquid is supplied from a liquid container to a liquid reservoir. In particular, although not exclusively, the invention relates to ink supply systems for inkjet printers, and apparatus for refilling the ink reservoirs and recycling ink used to purge the print heads.

Types of printers exist which make use of so called piezo-electric inkjet printing technology. A piezo-electric printhead (also sometimes referred to as PZT printhead) of such a printer is characterised in that it has a plurality of miniature jetting chambers or "jets" closely arranged in an array. Each jet is arranged to project ink from a respective one of an array of orifices defined by the printhead, and the jets are selectively energised by a controller to project (or not project as the case might be) "pixels" of ink. The ink is projected onto a substrate to be printed, relative movement between the printhead and the substrate resulting in ink projected from one orifice being deposited along an elongate path along the substrate. The printhead is arranged within the printer such that the array of jets extends at a predetermined angle (for example 90°) to the direction of the relative motion between the printhead and the substrate.

Piezo-electric inkjet printers are used in many office and industrial applications. Industrial printing applications include packaging printers, which print directly onto substrates such as cardboard boxes, trays, flexible film and labels.

Current industrial printers use a range of different inks in conjunction with a variety of different models of piezo-electric printheads. Some utilise liquid ink, others utilise solid ink, which is heated so as to phase-change to liquid within the printer, the ink being liquid at the time it is ejected from the jets.

Particularly in industrial applications significant amounts of ink may be consumed by an inkjet printer. It is desirable to be able to refill the ink reservoir within the printer with the minimum degree of interference to the inkjet printer, and in particular without removing the printer from operation during refilling, as even a relatively short cessation in printing may have significant impacts where the printer forms part of a production line process.

One known procedure for the refilling the ink reservoir within an inkjet printer is described in PCT Patent Application WO 99/04979. This describes a replaceable ink container in which the mouth of the container is closed by a puncturable diaphragm. The container is inverted such that the mouth is at the bottom and attached to the inkjet printing apparatus by means of a screw fit connection between the mouth of the container and a receptacle on the printing apparatus. A puncturing member carried by the ink reservoir pierces through the diaphragm, the diaphragm sealingly engaging the sides of the puncturing member preventing substantial ink loss. The puncturing member opens a conduit between the ink within the container and the ink reservoir. Ink within the container and atmospheric air within the reservoir may be exchanged via the puncturing member so ink can flow from the container into the reservoir.

Experimentation has shown, however, that if the bore of the puncturing member is relatively small and the ink reservoir contains, or is connected to, atmospheric air the ink in the container does not flow satisfactorily down the puncturing member (or other valve arrangement) because of the surface tension of the ink. As a small amount of ink leaves the container air is unable to pass into the container to replace it, resulting in low pressure in the container thus preventing further flow of ink into the reservoir.

It will be appreciated that this problem of achieving suitable flow out of an inverted container is one encountered in other areas, i.e. it is not limited to inkjet printer applications.

In certain industrial applications such as printing onto cardboard boxes significant amounts of airborne contaminants such as dust are generated. Contamination of the jets within the printhead of the printer is a significant problem, as they tend to become blocked by the contaminants such that they no longer eject ink properly. It is common practice, particularly in industrial applications, to follow a procedure often referred to as "purging" in order to maintain or restore the proper operation of the print jets. The purging procedure involves forcing ink through all of the jets in the printhead, with the intention of flushing out and removing any contaminants from the jets. The ejected ink must then be removed from the printhead either by allowing time for it to flow away or by providing mechanisms whereby its removal may be speeded up.

One such mechanism for purging inkjets is described in PCT patent application WO 02/36347. This describes an inkjet printer, which additionally incorporates an air curtain generator (which may also be referred to as an air knife) fixed in position relative to the printhead along one side of the array of jet orifices so as to direct a curtain of air across the array, thus cleaning the printhead and removing the ink which has been ejected from the jets during the purging procedure. A pressure pulse is applied to the ink within the printhead reservoirs sufficient to cause ink to be ejected from the jet orifices during the purging procedure, timed to coincide with the air curtain passing across the printhead during the purging procedure. A relatively large volume of ink (as compared with the volume of ink normally projected by an individual jet) is expended during a purging procedure. WO 02/36347 additionally includes a mechanism whereby the expended ink is collected and fed to a conduit for recycling, by being pumped through filters and returned to the ink reservoir. Currently these ink reclaim pumps are either motorised or solenoid pumps, significantly increasing the cost and complexity of the printing apparatus.

One of the devices described in WO 02/36347 uses a common supply of air to supply air to the air curtain generator, via a first controlled valve, and to the ink reservoir, via a second controlled valve. Clearly, the greater the number of controlled valves used in the system, the greater its cost and complexity. There is motivation, therefore, to use as few controlled valves as possible.

The various components of an inkjet printer ink supply system, e.g. the ink reservoir, ink container, ink reclaim pump, clearly require connection by suitable means. There is continued motivation to reduce the complexity, simplify the routing, and increase the reliability and robustness of the interconnections.

It is an object of embodiments of the present invention to provide liquid supply systems, printing apparatus, and inkjet printers which overcome, at least partially, one or more of the above-mentioned problems and disadvantages.

According to a first aspect of the invention there is provided a liquid supply system comprising: a liquid reservoir; a liquid container for supplying liquid to the reservoir; connection means connecting the reservoir to a position within the container that is immersed in the contained liquid; and means for alternately pressurising and depressurising the reservoir, the arrangement being such that when the reservoir is pressurised, gas is forced into the container through the connection means and accumulates above the liquid in the container, and such that when the reservoir is depressurised accumulated gas in the container forces liquid through the connection means to the reservoir.

The pressurising and depressurising may comprise increasing and reducing the pressure of gas already present in the reservoir, and/or may comprise supplying gas to, and extracting gas from the reservoir. Thus, a combination of techniques may be used. In certain preferred embodiments, the reservoir is alternately pressurised and depressurised with gas.

Thus, the connection means is both the means via which the supply container can be pressurised, to drive liquid to the reservoir, and the means via which the liquid is transferred to the reservoir.

For certain applications it may be preferable to arrange the system such that gravity urges contained liquid to flow from the container to the reservoir, and the connection means may comprise inhibiting means arranged to inhibit gravity feed of the reservoir with liquid from the container. Thus, the container may be conveniently arranged generally above the reservoir such that the liquid would tend to flow down to the reservoir, but the connecting means may be arranged to restrict, inhibit, or completely prevent such flow under gravity alone, so that uncontrolled supply to the reservoir, and potential over-filling may be avoided. Instead, controlled supply may be achieved by appropriate operation of the pressurising/depressurising means.

The connection means may comprise a conduit, which may be arranged to extend to the reservoir from the immersed position. The conduit may be arranged to extend up into the contained liquid, or in certain embodiments may extend down into the liquid, through the liquid surface. For example, the container may be an upright container, with the conduit extending down into the liquid via a sealed neck.

The connection means may comprise valve means (for example a two-way valve), which may be arranged to permit gas flow into the container, and liquid flow out of the container only when a sufficient pressure difference is applied across the valve. Conveniently, the valve means may comprise a slit in a membrane.

The valve means may provide the inhibiting means. Alternatively, or additionally, the connection means may comprise a tube having a bore dimensioned such that surface tension of the liquid inhibits flow of the liquid through the bore.

Thus, the connecting means may take a variety of forms, to suit particular applications. For example, it may comprise a conduit in the form of a tube or a hollow needle, an aperture, or a slit in a membrane. For certain applications it may be desirable to employ a conduit arranged to allow substantially free (i.e. unrestricted) flow of the liquid through it. In such cases, the conduit may take the form of a tube having a relatively large bore. For other applications, it may be desirable to use a conduit which restricts (inhibits) liquid flow through itself. For example, in applications where the container is inverted and arranged to supply the reservoir from above (such that the liquid in the container is above the level of the liquid in the reservoir) it may be desirable to use a restrictive conduit to prevent all of the supply rapidly flowing into the reservoir under gravity. The conduit may be arranged such that no appreciable flow can occur under gravity alone; to transfer liquid out of the container the pressurisation/depressurisation technique must be used. In this way, controlled delivery from the container can be achieved. The conduit may, for example, comprise a small aperture, or a tubular portion with a small bore, such that surface tension of the liquid inhibits flow. Alternatively, or additionally, the conduit may comprise two-way valve means, arranged to prevent fluid flow unless the pressure difference across it exceeds a certain value.

Advantageously the container may be substantially rigid and may contain a volume of gas above the contained liquid, whereby pressurisation of the reservoir to drive gas through the connection means into the container increases the gas pressure in the container. The rigid container may, for example, be an ink refill for an inkjet printer, and may be supplied containing a volume of gas. Alternatively, the container may be sufficiently deformable such that it can be supplied in a form containing no gas, but gas can still be introduced by the pressurising means (resulting in initial expansion of the container) at the beginning of the liquid supply process.

Preferably, the container comprises resealable valve means adapted to reseal the container when it is disconnected from the reservoir.

The resealable valve means may comprise a membrane, and the connection means may comprise a needle adapted to pierce the membrane to connect the ink inside the container to the reservoir.

Alternatively, the resealable valve means may comprise a valve member and biasing means biasing the member towards a valve seat.

Preferably, the system further comprises attachment means arranged to rigidly and releasably attach the container to a housing of the reservoir.

The attachment means may comprise a threaded neck on the container and a correspondingly threaded socket provided on the reservoir housing.

For certain applications, the container may, for example be or resemble a medical phial, i.e. a glass bottle with a metal cap that incorporates a rubber seal. The reservoir may comprise a needle for penetrating the seal. For certain applications it may be desirable to use a small diameter needle for ease of penetration and good sealing around the needle.

For other, preferred applications the needle and membrane may be discarded. The container may comprise a threaded spigot or collar, for example, extending from its neck, and this may be screwed into a threaded socket on the reservoir. An aperture through the spigot is sealed by means of an internal spring-loaded valve, which is automatically opened when the can (container) is screwed into the socket.

In certain embodiments, the system further comprises a filter. This may be arranged inside the reservoir, for example to filter liquid supplied from the container. In embodiments where reclaimed/recycled liquid is returned to the reservoir, the filter in the reservoir is preferably arranged to filter this returned liquid. It may not be necessary to filter the liquid supplied directly from the container In such embodiments, the means for pressurising and depressurising may be arranged to pressurise and depressurise a volume inside the reservoir and above the filter.

Advantageously, the means for pressurising and depressurising comprises a compressed gas supply, a compressed gas conduit connecting the compressed gas supply to a compressed gas inlet of the reservoir, and control means arranged to control supply of the compressed gas from the supply into the reservoir.

Preferably, the control means is adapted to supply pressure pulses to the reservoir. This is particularly advantageous in applications where the system is used to supply ink from an ink refill container to the ink reservoir of an inkjet printer, the reservoir being arranged to supply the ink to a print head. This is because the pressure pulses can be used to periodically purge the orifices of the print head as well as driving ink from the supply container in a controlled manner. Thus, the pulses may have dual function.

Preferably, and especially for inkjet printer applications the pressure pulses are arranged to have relatively rapidly rising leading edges and relatively slowly falling trailing edges. This form of pulse is particularly good for purging print head orifices and leaving the inkjet chambers in a primed state.

Conveniently, the control means may comprise a controllable valve.

Advantageously, the control means may further comprises a passive valve arranged downstream of the controllable valve, the passive valve being adapted to initially allow gas flow towards the reservoir when an inlet of the passive valve is exposed to pressurised gas from the supply as a result of the controllable valve being opened, and then to close automatically after a period of time in response to continued exposure, to prevent further flow, and to remain closed until the pressure at the inlet to the passive valve drops below a predetermined threshold, whereby pressurised gas is supplied to the reservoir via the controlled and passive valves.

This arrangement provides the advantage that a short pressure pulse can be generated by a single operation of the controlled valve (i.e. a single change of its state, from closed to open), and the duration of the short pulse is not determined by the closing of the controlled valve.

Preferably, the passive valve comprises a valve member biased towards a first position in which gas flow through the passive valve is permitted, the valve member being deflectable when exposed to the pressurised gas from the supply, as a result of the initial pressurised gas flow, to a second position in which it engages a valve seat and prevents further gas flow, continued exposure to the supply maintaining the valve member against the seat, the time taken to deflect the valve member from the first to the second position determining said period of time (i.e. the automatic open period), and hence the length of a pressure pulse transmitted by the passive valve.

In certain preferred embodiments, the valve member comprises a ball, biased under gravity to sit in a first position in a valve chamber, the passive valve inlet being arranged to direct supplied pressurised gas up into the chamber, initially to flow past the ball, the ball being arranged so as to be lifted by the gas flow to a second position in which it is brought into sealing engagement with a valve seat, preferably comprising an o-ring, and closes the passive valve.

Advantageously, the system may comprise at least one device having a compressed gas inlet connected so as to be supplied with compressed gas extracted from the compressed gas conduit at a position downstream of the active (i.e. controllable) valve, and preferably upstream of the passive valve. Thus, the output of the first, controlled valve may be used to control one or more auxiliary devices, as well as supplying the passive valve to generate the shorter pressure pulses. This arrangement is again particularly advantageous in inkjet printer applications where the controlled valve output may be tapped off to supply relatively long pressure pulses to operate an air knife/air curtain generator, to periodically direct air flow over the inkjet orifices, and/or to operate a diaphragm pump arranged to return ink collected from the printhead to the reservoir. As mentioned above, the shorter pulses automatically generated downstream, at the outlet of the passive valve, may have dual function, in that they drive the ink supply and drive the periodic purging of the orifices. Thus, by controlling a single valve, three or four operations can be driven simultaneously. By tapping off longer air pulses between the controlled and passive valves to supply the air curtain generator, and generating the shorter purge/ink supply pulses using the passive valve, the periodic purging of the orifices is automatically synchronised with the air curtain such that as ink is forced out, air flow is present to deflect the ink across a surface of the orifice plate, to be collected by suitable means and then recycled.

Thus, the at least one device may, advantageously, comprise a pump, which may be a diaphragm pump, and/or an air knife or air curtain generator.

Preferably, the means for pressurising and depressurising comprises a gas exhaust conduit connecting a gas outlet of the reservoir to atmosphere, the gas exhaust conduit comprising restriction means arranged to restrict flow of gas from the reservoir to atmosphere. The characteristics of the exhaust restriction thus determine the shape of the trailing edge of the pressure pulses experienced in the reservoir.

The restriction means may be adjustable or fixed.

Advantageously, the gas outlet of the reservoir is provided by the gas inlet (e.g. the inlet and outlet may be a common port), and the gas exhaust conduit may comprise a portion of the compressed gas conduit and a branch off the compressed gas conduit, the restriction means being located on the branch.

This branch may be arranged such that it branches from the compressed gas conduit at a position downstream of the passive valve.

Advantageously, the system may be adapted for use in an inkjet printer, the liquid container containing a quantity of ink, and the reservoir being an ink reservoir adapted to supply ink to a print head. The liquid container may be an ink refill container.

In inkjet printer applications, the system may be arranged such that when the reservoir is pressurised to force gas into the container, pressure is applied to a surface of ink in the reservoir to force ink to the print head (e.g. to purge print head orifices).

Another aspect of the invention is an inkjet printer comprising: a print head having at least one orifice from which a jet of ink can be ejected; and a liquid supply system in accordance with the first aspect, the liquid container being an ink container, and the reservoir being an ink reservoir arranged to supply ink to the print head.

In embodiments of this aspect, the means for pressurising and depressurising may be arranged to supply pressure pulses to the reservoir, the pressure pulses being arranged to simultaneously force gas into the ink container and force ink to the print head to purge the at least one orifice.

Where the inkjet printer utilises a supply system comprising a controlled valve and a passive valve, and a portion of the gas flowing from the outlet of the controlled valve is tapped off to supply at least one auxiliary device, that device may, advantageously be a compressed-gas-operated (i.e. driven) pump arranged to pump ink reclaimed from the print head back into the reservoir. Thus, control of the controllable valve also controls the operation of the pump.

Additionally, or alternatively, the at least one device may comprise gas curtain generating means arranged to direct a curtain of gas across a surface of the print head, over the at least one orifice. Thus, control of the controllable valve also controls the gas curtain. Synchronisation of the purge pulses and curtain pulses may be automatically achieved, and derivation of the purge pulse from the longer curtain pulse using the passive valve can, advantageously, ensure that air flow continues over the orifices for a time after the ink flow out of the orifices has ceased.

According to another aspect of the invention there is provided an ink container for use with an inkjet printer, the container being sealed and containing a quantity of ink and a volume of gas, the gas being at a pressure when the container is sealed substantially less than 1 bar. Preferably, said pressure is no more than 0.95 bar, and even more preferably is less than 0.7 bar. A typical container may contain approximately 180 cc of ink and 30 to 40 cc of air. Other sizes may of course be used.

The container may be an un-pressurised aerosol-type can, conveniently arranged to self-seal when unscrewed, such that it can be removed when partially empty without spillage, even when upside down.

Another aspect of the invention provides a method of supplying liquid to a liquid reservoir from a liquid container, the method comprising the steps of: connecting the reservoir to a position within the container that is immersed in the contained liquid; and alternately pressurising and depressurising the reservoir, such that when the reservoir is pressurised, gas is forced into the container through the connection and accumulates above the liquid in the container, and such that when the reservoir is depressurised accumulated gas in the container forces liquid through the connection means to the reservoir.

The step of alternately pressurising and depressurising the reservoir preferably comprises applying a series of pressure pulses to the reservoir, and the method may further comprise the step of using the series of pressure pulses to purge ink through the printhead of an inkjet printer.

Advantageously the step of alternately pressurising and depressurising the reservoir may comprise the steps of generating (for example from a compressed gas supply) a first pressure pulse having a first length, generating from the first pulse a second pressure pulse having a second, shorter length, and applying the second pressure pulse to a volume inside the reservoir.

The step of generating the first pressure pulse conveniently comprises supplying compressed gas to the inlet of a controllable valve, opening the valve, and then after a period of time closing the valve.

Advantageously, the step of generating the second pulse comprises supplying the first pulse to the inlet of a valve adapted to close automatically after a period of exposure to the first pulse, and to remain closed for the remaining duration of the first pulse.

Preferably, the method further comprises the step of supplying the first pulse to operate an auxiliary device.

Conveniently, the step of pressurising the reservoir comprises supplying pressurised gas to a volume inside the reservoir, and the step of depressurising the reservoir comprises reducing gas pressure in the volume by venting the volume to atmosphere via a restriction (typically a hole/orifice).

According to another aspect of the invention, there is provided an inkjet printer comprising: a print head comprising at least one orifice from which, in use, an ink jet may be ejected; an ink reservoir connected to supply ink to the print head; and means for applying a pressure pulse to ink within the reservoir to cause ink to be discharged from said at least one orifice, the means for applying a pressure pulse comprising a supply of compressed gas connected to the inlet of a controllable valve, and control means arranged to open and close said valve, the means for applying a pressure pulse further comprising a second, passive valve, having an inlet connected to the outlet of the controllable valve, the second valve being adapted to initially allow gas flow towards the reservoir when the second valve inlet is exposed to pressurised gas from the supply as a result of the controllable valve being opened, and then to close automatically after a period of time in response to continued exposure, to prevent further flow, and to remain closed until the pressure at the inlet to the passive valve drops below a predetermined threshold, the outlet of the second valve being connected to the reservoir to apply said pressure pulse to the ink.

This provides the advantage that a suitable purge pulse can be generated by a single operation of a single controllable valve.

The passive valve may, conveniently, be as described above in relation to the first aspect.

Preferably, the inkjet printer further comprises a gas exhaust conduit connecting a gas outlet of the reservoir to atmosphere, the gas exhaust conduit comprising restriction means arranged to restrict flow of gas from the reservoir to atmosphere, the restriction enabling gas to bleed out of the reservoir after gas has been supplied to the reservoir at pressure via the first and second valves, so reducing gas pressure in the reservoir and determining the shape of the trailing edge of the pressure pulse.

Advantageously, the inkjet may further comprise a pneumatic pump having a compressed gas inlet connected so as to be supplied from a position between the outlet of the controllable valve and the inlet of the passive valve, such that control of the controllable valve also controls the supply of compressed gas to the pump and hence operation of the pump, the pump being arranged to pump ink, and preferably to pump ink reclaimed from the print head back into the reservoir.

Alternatively, or additionally, the inkjet printer may further comprise gas curtain generating means (which may also be referred to as an air knife) arranged to direct a curtain of gas across a surface of the print head and the at least one orifice, the gas curtain generating means having a compressed gas inlet connected so as to be supplied from a position between the outlet of the controllable valve and the inlet of the passive valve, such that control of the controllable valve also controls the supply of compressed gas to the gas curtain generating means.

Thus, by controlling a single controllable valve, pressure pulses suitable for use as purge pulses, and pressure pulses for operating an ink reclaim pump and/or an air knife may be generated.

Another aspect of the invention provides an inkjet printer comprising: a print head comprising at least one orifice from which, in use, an inkjet may be ejected; an ink reservoir arranged to supply ink to the print head; gas curtain generating means arranged to direct a curtain of gas across a surface of the print head and the at least one orifice; a pump arranged to pump ink into the reservoir; a compressed gas supply; a controllable valve, having an inlet connected to the compressed gas supply and an outlet connected to the gas curtain generating means; and control means arranged to control operation of the valve to control supply of compressed gas to generate the gas curtain, wherein the pump is a pneumatic pump, having an compressed gas inlet connected to the outlet of the controllable valve, and the control means is arranged to operate the controllable valve to generate pressure pulses to simultaneously operate the pump and generate the gas curtain.

Preferably, the gas curtain is an air curtain, and the ink pump is arranged to recycle ink from the print head back into the reservoir.

The printer may further comprise a passive valve, arranged as described above, for automatically generating pressure pulses for purging the print head orifices and/or driving supply of ink into the reservoir from a container.

According to another aspect of the invention there is provided an ink supply system for an inkjet printer, comprising: an ink reservoir adapted to supply ink to a print head; an ink container, for supplying ink to the reservoir, and containing a quantity of ink; connection means connecting the ink reservoir to a position within the ink container that is immersed in the contained ink; and means for alternately creating a pressure difference between the reservoir and the container in a first direction, such that ink flows from the container, through the connection means, and into the reservoir, and creating a pressure difference between the reservoir and the container in a second, opposite direction such that gas flows from the reservoir, through the connection means, and into the container and accumulates above the contained ink.

The container may be deformable, and the means for creating the pressure differences may comprises means for deforming and reforming the container.

If the container is initially completely full of ink (no gas) then a first deformation can exert pressure directly on the contained ink, forcing it out of the container, into the reservoir.

If the container contains some gas above the ink (either initially, or after some of the ink has been driven out) then the deformation may compress the gas and hence increase its pressure. This in turn exerts an increased force on the surface of the ink to drive ink out through the connection means. The connection means may take a variety of forms, as described above in relation to previous aspects.

Thus, in certain embodiments, the means for alternately creating pressure differences can be arranged to repeatedly squeeze a semi-rigid container. In such embodiments, the container may be resilient, such that when the squeezing/deforming force is removed, it springs back into shape. This will result in a momentary expansion of the contained gas, and a reduction in gas pressure, creating a pressure difference by which gas can be drawn into the container from the reservoir.

Alternatively, the container may be substantially rigid, and may be supplied with a quantity of gas already contained within it.

In circumstances where the container contains a quantity of gas above the contained ink, the means for creating pressure differences may be arranged to create pressure differences between gas in the reservoir and gas in the container.

Typically, the connection means will connect the container to a position in the reservoir that contains gas and is above an ink level.

In certain preferred embodiments, the means for alternately creating the pressure differences comprises means for alternately pressurising and depressurising the reservoir. As for the other aspects of the invention, it will be appreciated that the terms "pressurising" and "depressurising" are relative. For example, pressurising may involve increasing a gas pressure inside the reservoir above an initial, "normal" level (e.g. atmospheric pressure), and depressurising may comprise reducing pressure back down to that initial level. Alternatively, depressurising may comprise reducing pressure from an initial level, and pressurising may comprise raising pressure back up to that level.

Also, as with the preceding aspects, pressurisation of the reservoir may comprise raising the pressure of a gas already present in the reservoir (for example by driving a moveable member to reduce a volume in the reservoir), and/or may comprise supplying gas to the reservoir. A combination of these techniques may be used.

According to another aspect of the invention, there is provided an ink supply system for an inkjet printer, comprising a main body member and at least one auxiliary body member mounted on the main body member to form an assembly such that an ink reservoir cavity and a pump cavity are defined within the assembly, the pump cavity enclosing a displaceable element which divides the pump cavity into first and second chambers, the first chamber being in communication with the ink reservoir cavity and a pressurised gas inlet via a first conduit, and the second chamber being in communication with an ink inlet via a second conduit which includes a one-way valve that prevents flow of ink from the second chamber to the ink inlet, and the second chamber being in communication with the ink reservoir cavity via a third conduit which includes a second one-way valve that prevents flow of ink from the ink reservoir cavity to the second chamber, the displaceable element being arranged such that pressurisation of the first conduit to pressurise the ink reservoir cavity displaces the element to pump ink from the second chamber to the ink reservoir cavity.

For example, the main body member may comprise a block, and the auxiliary body member may comprise a head, mounted on top of the block.

It will be appreciated that the first chamber may be connected directly or indirectly to the reservoir.

Conveniently, the displaceable element comprises a diaphragm, and this may be sandwiched between the main body member and the auxiliary body member. In such examples, the second chamber may be provided by a cavity in the main body member and the first chamber may be provided by a cavity in the auxiliary body member.

Preferably, the diaphragm comprises part of a sheet of material sandwiched between the main and auxiliary body members.

The first conduit may further comprise a valve having a valve chamber, the valve chamber being defined inside the assembly, for example being defined by a cavity in the main body member. This valve may be a passive valve, as described above.

The first conduit may comprise a passageway within the assembly, and may additionally, or alternatively, comprise a conduit external to the assembly, but preferably the second and third conduits are entirely contained within the assembly.

It will be appreciated that, for many applications, air is a suitable and convenient gas to use in embodiments of the invention. However, other gases may of course be used.

Other objects and advantages of the present invention will become apparent from the following description.

Embodiments of the invention will now be described, by way of example, with reference to the accompanying drawings, of which:

Figure 1:
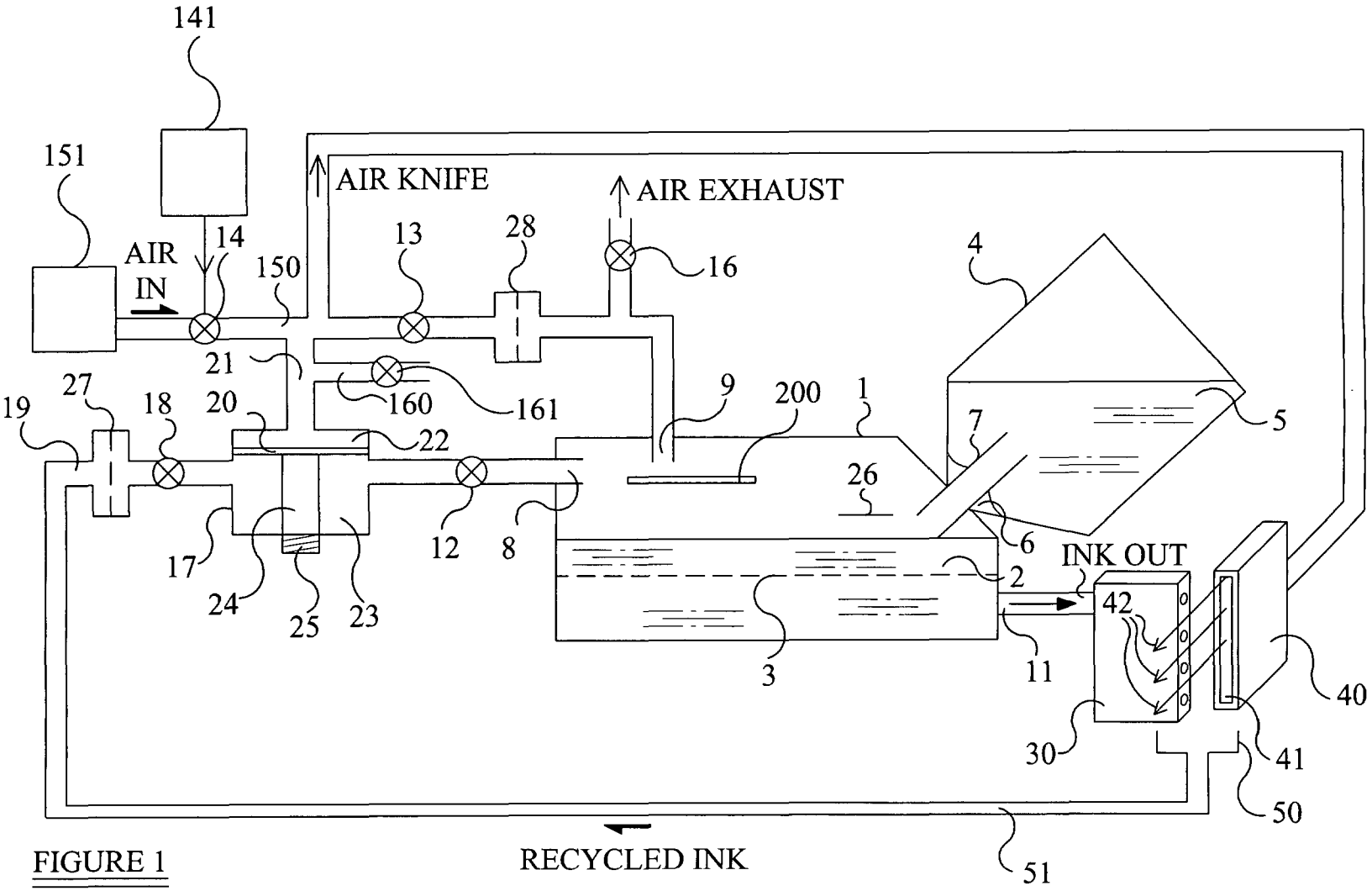
FIG. 1 is a schematic diagram of an ink supply system embodying the invention.

FIG. 1 schematically illustrates an ink supply system embodying the present invention. The illustrated system is incorporated in an inkjet printer, a printhead 30 of which is supplied from a reservoir 1 which contains a body of ink 2. The reservoir 1 houses a filter represented schematically by broken line 3. The reservoir is refilled from an ink container 4 containing a body of ink 5. The container 4 incorporates a sealing mechanism which in the schematically illustrated case comprises a diaphragm 6 punctured by a needle 7 which opens into the reservoir 1. It will be appreciated that the needle may be attached to, or part of, the reservoir.

The needle 7 thus provides fluid connection means between the container 4 and the reservoir 1. In other embodiments the fluid connection means may take different forms, and may comprise a valve, tube or other conduit.

In this first embodiment, the container 4 is inverted, such that the needle 7 extends up into the contained ink, and gravity urges the ink to flow towards (i.e. down into) the reservoir. In this example the container is in contact with the reservoir, but this arrangement is not necessary.

The interior of the reservoir 1 also communicates with a recycled ink inlet 8, and a compressed air inlet and outlet 9. Ink flows from the reservoir through an ink outlet 11 to the inkjet print head 30. A non-return valve 12 is connected to the ink inlet 8 to prevent ink or air escaping from the reservoir 1 through the inlet 8. A valve 13 is connected to the compressed air inlet 9 which allows high pressure air to flow into the reservoir 1 through the inlet 9 then closes after around 20 milliseconds. Valve 13 allows low pressure air flow in both directions at all other times.

A controllable valve 14 is connected between a compressed air supply inlet 15 and valve 13. A controller 141 is arranged to control operation of the valve 14. The controllable valve 14 is normally closed but may be opened to supply a relatively long pulse, typically 250 milliseconds, of compressed air from a high pressure air supply 151, eg. at 3 bar, to an air knife 40 for cleaning of purged ink from the printhead front plate 31. This pressure of 3 bar may be an absolute pressure, but more usually will be a gauge pressure, i.e. a pressure above local atmospheric pressure. The air knife 40 is thus supplied with pulses of compressed air, extracted from the air conduit to the reservoir at a position between the outlet of the controlled valve 14 and the inlet of the passive valve 13. This results in the periodic generation of an air curtain 42 (emitted from an outlet 41) across the print head surface 31, and hence across an array of orifices 32 in surface 31. Purged ink, i.e. ink emerging from the orifices during the application of the purge pressure pulses to the ink in the reservoir, is thus deflected transversely, away from the orifices, and can then flow down a surface of the print head, under gravity. This ink is then collected by a collector 50, which is connected by a recycled ink conduit 51 to the inlet 19 of a filter 27, which is in turn connected to the inlet of a diaphragm pump 17, via a non-return valve 18.

Valve 14 also provides a pulse of compressed air through a compressed air conduit including the valve 13, filter 28 and the compressed air inlet 9 to the space within the reservoir 1 above the body of ink 2. Since most of the 3 bar air pressure available from the supply is vented to atmosphere by the high flow rate of the air knife, and since valve 13 in this embodiment closes after around 20 milliseconds, the pulse which reaches the space within the reservoir 1 above the body of ink 2 is of lower pressure than the supply pressure and shorter duration than the pulse going to the air knife and is typically 0.5 bar (gauge pressure) and 20 milliseconds respectively. After the 20 millisecond pulse the pressurised air in the space within the reservoir above the ink will vent through restrictor 16. A small amount of air will also escape from restrictor 16 during the 20 millisecond pulse, but that is tolerable. The restrictor 16, which may be manually adjusted or can be a fixed type, determines the rate at which the 20 millisecond pulse decays back to atmosphere. There is also a baffle 200 over the compressed air inlet 9, arranged to prevent the compressed air pulse from disturbing the surface of the ink by forming air bubbles for instance.

It will be appreciated that the pressure pulse applied to the ink 2 in the reservoir 1 may conveniently be referred to as a first pressure pulse, and control of the valve 14 to open, and then close after a period of time, may be described as generating a second pressure pulse at the valve 14 outlet. This second pressure pulse, or a pressure pulse derived from it, is then applied to an inlet of the gas curtain generating means, which in the example shown in FIG. 1 is an air knife 40. Thus, the pressure pulse applied to the air knife inlet, which may itself be referred to as a second pressure pulse, is supplied from the controllable valve outlet.

As described in published international patent application number WO 02/36347, it is desirable to apply a pressure pulse to ink within an ink reservoir supplying an inkjet print head so as to purge ink from individual orifices defined by that printhead, and to control the pressure pulse so as to have a relatively steeply rising leading edge and a relatively slowly falling trailing edge. This can be achieved with the arrangement illustrated in FIG. 1 by delivering compressed air through the inlet 9 for a relatively short period of time (typically a few tens of milliseconds) and then allowing the pressure within the reservoir to decay relatively slowly as a result of leakage of air through the restrictor 16. The application of a pressure pulse in this manner to ink within the reservoir can however also be used in accordance with certain embodiments of the present invention to ensure the flow of ink from the ink container 4 into the reservoir 1, in order to replenish the reservoir.

It is desirable when a full ink container 4 with a pierceable membrane 6 is first mounted on the needle 7 to avoid any ink spillage. It is also desirable to be able to remove the ink container even when it is not empty without spillage occurring. Typically the container 4 will be screwed into an appropriate socket in the system and there is a risk that leakage can occur as the container is installed. This risk is much reduced if the needle 7 is of relatively small diameter. Also the risk of ingress of dirt when no ink container is present is greatly reduced if the diameter of the needle is relatively small. However, if the needle 7 is of relatively small diameter it is difficult (and may indeed be impossible) to achieve a reliable flow of ink from the container while relying on gravity. This problem arises because, as ink flows from the container, pressure in the container above the surface of the body of ink 5 falls. This pressure opposes the effect of the weight of the ink within the container tending to cause the ink to flow through the needle 7. Indeed if the needle 7 is of small diameter, then, even when the container is full it may be that ink will not flow through the needle 7. Thus, in certain embodiments of the invention pressurisation means is provided for applying pressure to the space above the body of ink 5 so as to ensure that ink does flow through the relatively small needle.

Assuming that the bottom end of the needle 7 is above the surface of the body of ink 2 within the reservoir (i.e. it is in communication with a gas-filled volume inside the reservoir) and that ink will not flow downwards through the needle 7, for the reasons described above, and that the pressure above the body of ink 2 within the reservoir 1 is at atmospheric pressure as the result of leakage through the restrictor 16, if a pulse of pressure is then applied via the compressed air inlet 9 air will be forced up the needle 7 so as to bubble through the body of ink 5 in the container 4. Each time a pulse of pressure is applied air will flow up through the needle 7 until the pressure in the container 4 above the body of liquid 5 is sufficient to push ink down through the needle 7 when the pressure within the reservoir has returned to atmospheric. In other words, each time a pressure pulse is applied, air flows up the needle and increases gas pressure in the container. Then, as pressure in the reservoir is reduced, the pressurised air in the container is able to expand, pushing ink out of the container. The accumulated gas cannot simply escape back down the needle because the upper end of the needle is submerged under ink in the container. Thus, simply by applying an elevated pressure pulse to the interior of the reservoir (typically from 0.25 to 1 bar), and then releasing that pressure the reliable delivery of ink from the container 4 is ensured.

When the ink level rises in the reservoir to the level indicated by reference numeral 26, enough to cover the lower end of the needle, no more air can enter the needle 7 and the ink level rises no further. Ink level control is thus established at this level, 26, in the reservoir.

In this embodiment the needle has an outer diameter (OD) of 2.4 mm and an internal diameter (ID) of 1.6 mm. In other embodiments, different dimensions may, of course, be used.

Thus, applying a series of pulses of pressure to the space above the body of ink 2 within the reservoir 1 achieves two purposes, that is, ensuring the controlled supply of ink from the container 4 and applying a purging pulse to any printhead connected to the ink outlet 11. As described below this same pulse application procedure can be used to perform a third function, that is recycling of purged ink.

When a printhead is purged, it is desirable to remove purged ink from the printhead face. That ink can be simply discarded but this represents unnecessary waste. Generally it is desirable to collect the ink and return it to the ink supply system. One arrangement for such ink collection and recycling is described in international patent application number WO 02/36347. Assuming ink is collected for recycling, it is desirable for that ink to be pumped to the main supply reservoir.

In the example schematically illustrated in FIG. 1, this is achieved using a diaphragm pump 17 connected upstream of the non-return valve 12 and downstream of a further non-return valve 18. An inlet side of the non-return valve 18 is connected to a recycled ink inlet 19 via a filter 27, and recycled ink is delivered to the inlet 19 by conduit 51. The valve 18 permits ink flow only in the direction from the inlet 19 to the pump 17. The pump 17 comprises a diaphragm 20 an upper surface of which communicates via a compressed air inlet 21 with the controllable valve 14. The air inlet 21 branches from an air conduit 150 connected to the output of the controlled valve 14. A restriction 161 is arranged on a further branch 160 off the air inlet 21 and vents some of the supplied air to atmosphere. The restriction 161 may be fixed or adjustable. It is set to give a desired pumping action from the pulses supplied by the controlled valve.

The diaphragm 20 divides the interior of the pump 17 into a first chamber 22 and a second chamber 23. The diaphragm 20 rests on support member 24 which is biased by a spring 25 in a direction such that the volume of the upper chamber 22 which communicates with the air supply is reduced and the volume of the lower chamber 23 which is filled with recycled ink is increased. When the valve 14 is opened, the supplied compressed air pushes against the action of the spring 25 so as to reduce the volume of the ink-filled chamber 23, resulting in the flow of recycled ink through the non-return valve 12 to the reservoir 1. The non-return valve 18 prevents backflow of ink. When the compressed air supply valve 14 is closed, the spring 25 pushes the diaphragm 20 to its initial position, enlarging the size of the chamber 23 and causing recycled ink to be sucked in through the non-return valve 18. The non-return valve 12 prevents air flowing into the chamber 23 from the reservoir. Thus recycled ink is pumped using a mechanism powered entirely from the compressed air system used to deliver pulses of compressed air for purposes unrelated to recovery of recycled ink. It will be appreciated that, in practice, the pump will typically be pumping a mixture of air and reclaimed ink. The pumping rate is set fast enough to accommodate the rate at which purged ink enters the reclaim arrangement. The restriction 161 in part determines the pumping rate.

In the embodiment shown in FIG. 1, a fine filter 3 is employed inside the reservoir. Although fine, this filter has large area, and is particularly important for filtering out any contaminants or debris that may have been introduced into the reservoir. Ink must pass through the filter 3 before it can reach the print head 30.

Another advantage of the system shown in FIG. 1 is that if, for some reason (such as transportation) it becomes desirable to empty the reservoir, the apparatus can be rotated (e.g. inverted) such that the reservoir end of the needle is immersed in reservoir ink, the container end of the needle now being in communication with contained gas. Then, pressure pulses can be applied to the reservoir in the same way as described above, to gradually drive the reservoir ink back into the container.

Figure 5:
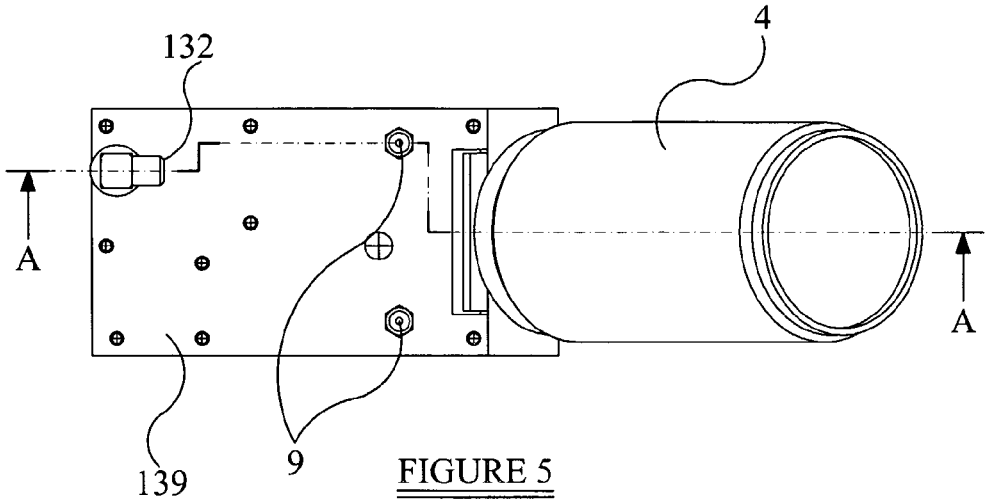
FIG. 5 is a view, from above, of part of a liquid supply system embodying the invention.
Figure 6:
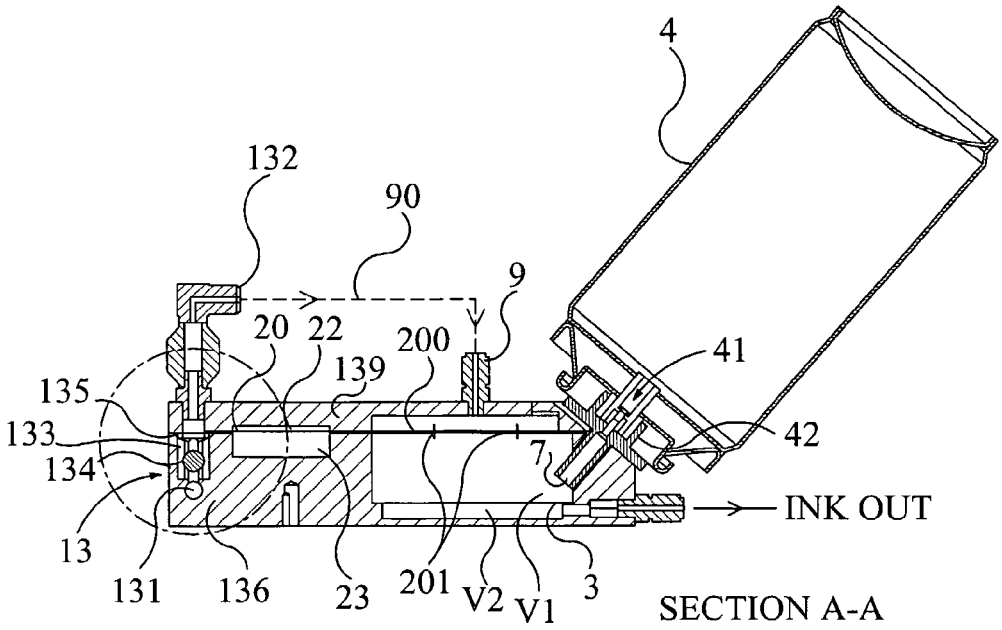
FIG. 6 is a cross section of the apparatus from FIG. 5, along line A-A.

In certain preferred embodiments, such as that shown in FIGS. 5 and 6, the pierceable membrane closure is replaced by a closure containing a mechanical valve 41 which is normally held closed by a spring and the needle is replaced with a blunt tube. When the container is inserted into a socket 42, the tube causes the valve to be opened, on removal of the container the valve closes. This prevents leaks more effectively than the diaphragm and eliminates the risk of injury by the sharp needle.

In embodiments utilising a blunt tube interfacing with the valve of a rigid (e.g metal) container, the tube may, for example, have an OD of 3.2 mm and an ID of 2.0 mm. Again, these are only exemplary figures, and the dimensions of the various components will be selected to suit particular circumstances and applications.

Typically the container or closure will have a screw thread which screws into the socket for easy retention and removal, but non-threaded containers are also possible, held in place by some other means. The container can be made of metal, plastic, glass etc. It will be appreciated that many materials are suitable.

In the embodiment shown in FIGS. 5 and 6 the container 4 is rigid. If a container of rigid construction is used then in certain embodiments of this invention it is preferable that a small amount of air is included in the container even when it is nominally full of ink. This is because in order for the pressurised air pulse to force air up the needle (or through some other connection means), it has to either compress the contents of the container slightly or increase the volume of the container slightly.

In certain embodiments of the invention, the liquid, e.g. ink, is packed in the container at atmospheric pressure. However, it is desirable to avoid a particular problem which can occur when a container is packed at atmospheric pressure at one location and time but is used at a lower atmospheric pressure, e.g. at another location and time, since local atmospheric pressure varies generally with height above sea level and with time. In this case as soon as the container is inserted into the socket, the lower external pressure will cause an amount of ink to drain at once from the container into the reservoir, potentially causing an overfilling problem. The solution to this particular problem is, when packing the ink into the container, to include the small amount of air at slightly lower than atmospheric pressure, such that whatever the local atmospheric pressure when the container is first used, no significant amount of ink will be fed unintentionally. It will be appreciated that this lower air pressure is equalised the first time the ink container is used, and therefore does not affect the way the invention operates as described herein. The container may thus contain a volume of gas, e.g. air, at a pressure substantially below 1 bar, and preferably less than 0.95 of an atmosphere.

Figure 2:
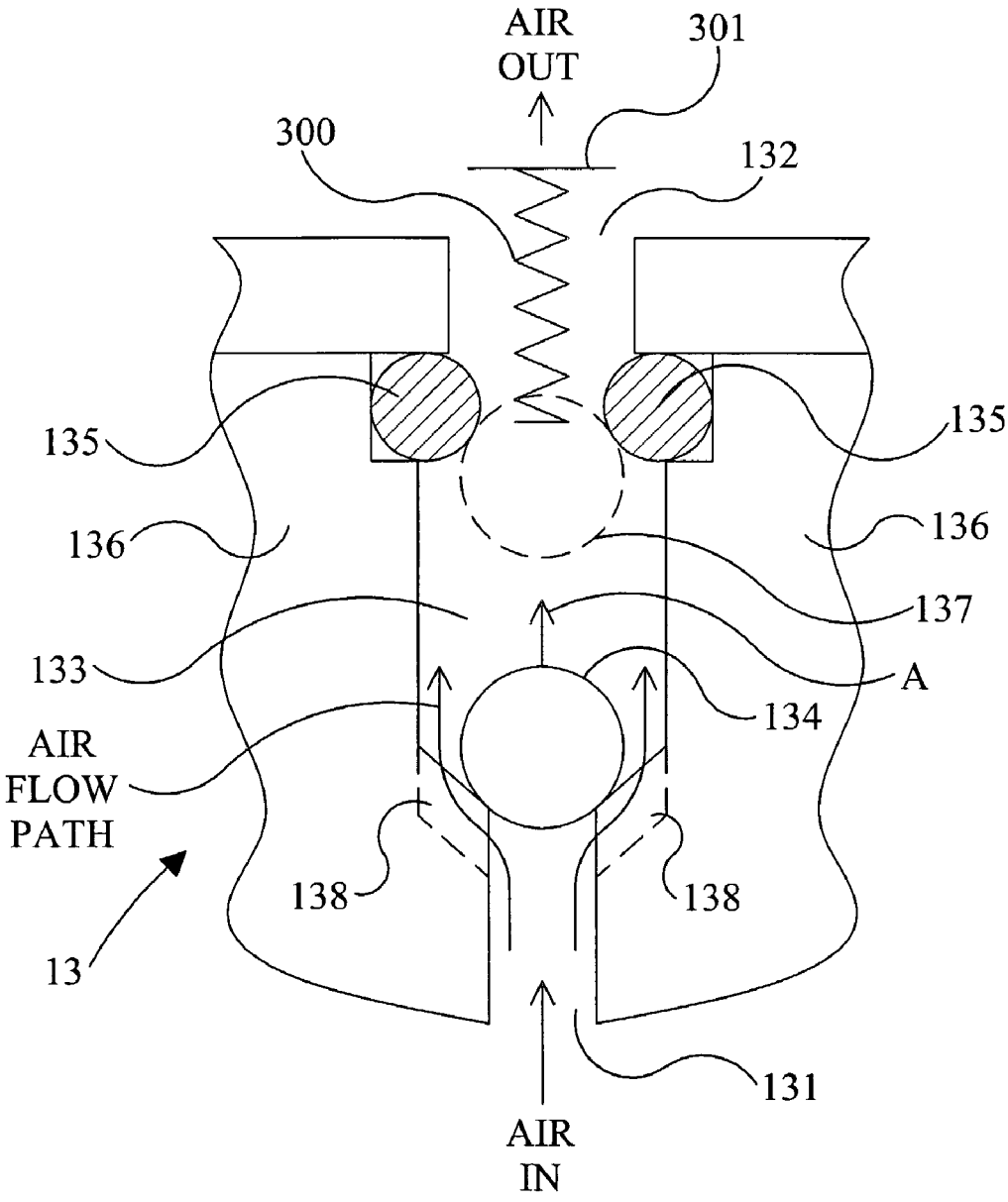
FIG. 2 is a schematic cross section of a passive valve suitable for use in embodiments of the invention.

Referring now to FIG. 2, this shows a passive (i.e. not requiring active control) valve 13 suitable for use in embodiments of the present invention, and indeed suitable for use in the supply system illustrated in FIG. 1

The purpose of this valve is to allow free flow of air in one direction at relatively high supply pressure e.g. 0.5 bar (gauge pressure), but to close after a predetermined length of time, thereby turning a long duration input pressure pulse into a short duration output pressure pulse. In certain embodiments, the valve must also allow free flow in the either direction at lower pressures.

In this particular valve, the desired performance is achieved by the action of a 5 mm ball bearing 134 normally held by gravity at the bottom of a vertical hole, i.e. valve chamber 133, provided in a valve housing 136. Thus, the ball 134 is biased to sit in this first position. The valve has an air inlet 131, arranged to direct inflowing gas up into the chamber 133. Air flow channels 138 are provided so that even when the ball is in the first position, low pressure air can flow up past the ball and to the valve outlet 132. The air flow path is vertically up the hole, around the sides of the ball with enough clearance such that low pressure air flow will not move the ball vertically against gravity. When the pressure of the airflow is high enough, e.g. 0.25 bar, the ball is lifted up the hole (chamber 133) in the direction shown by arrow A, to a second position 137 in which seals against an o-ring 135 positioned at the top of the hole for this purpose. Thus free flow of air through the valve is permitted for as long as it takes for the ball to rise up the hole and seal against the o-ring. A weak return spring 300 is arranged such that as the ball seats against the o-ring it engages a lower end 302 of the spring and compresses it slightly against a stop 301. The ball stays in the sealed position until the air pressure is removed from the bottom of the hole. By exerting a small returning force (downwards in this example) on the seated ball, the compressed return spring helps to disengage the ball from its seat (and hence reopen the valve) when the supply pressure is cut off.

Figure 3:
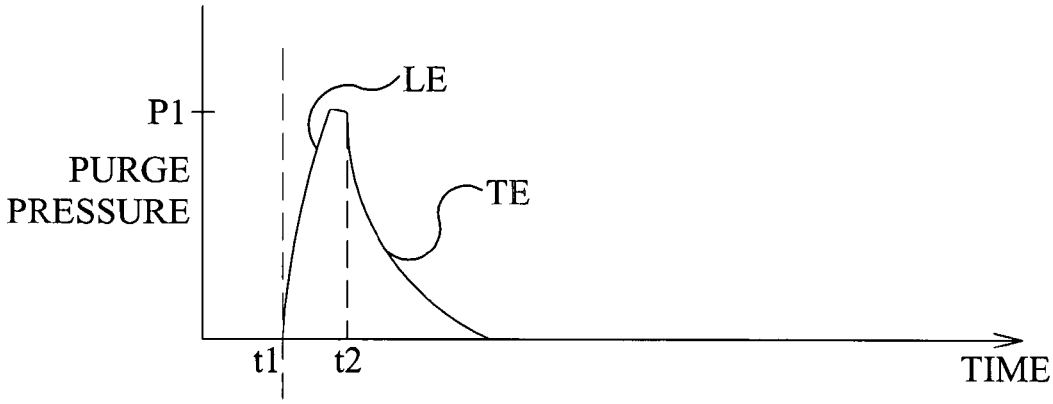
FIG. 3 illustrates the shape of the pressure pulse experienced in the volume above the ink level in the reservoir of the first embodiment.

Although the valve 13 on FIG. 2 employs a moveable ball, other constructions are possible for the passive valve, such as by using a moving disc or a moving rubber flap etc. Generally, the valve 13 may comprise a member, deflectable by gas flow at sufficient pressure to a sealing position, in which it remains until the high pressure supply ceases. Referring to FIG. 3, this shows a typical purge pressure pulse applied to the ink surface in an inkjet printer embodying the invention. It may conveniently be produced with the apparatus shown in FIG. 1, using a valve as shown in FIG. 2. This same pulse may also be used to controllably drive ink from a refill container into the reservoir. The pulse has a steep (rapidly rising) leading edge LE, and a slowly falling (decaying) trailing edge TE. This pulse may be produced using the series combination of controlled valve and passive valve as shown in FIG. 1. In such a case, the time interval between the start of the leading edge (t1) and the start of the trailing edge (t2) is determined by the automatic cut-off period of the passive valve for the particular gas supply pressure. Time t1 corresponds to the opening of the controlled valve, and time t2 corresponds to the closing of the passive valve. The decaying trailing edge is conveniently produced by allowing the pressurised ink reservoir to bleed to atmosphere, or some other relatively low pressure region, through suitably arranged restriction means.

Figure 4:
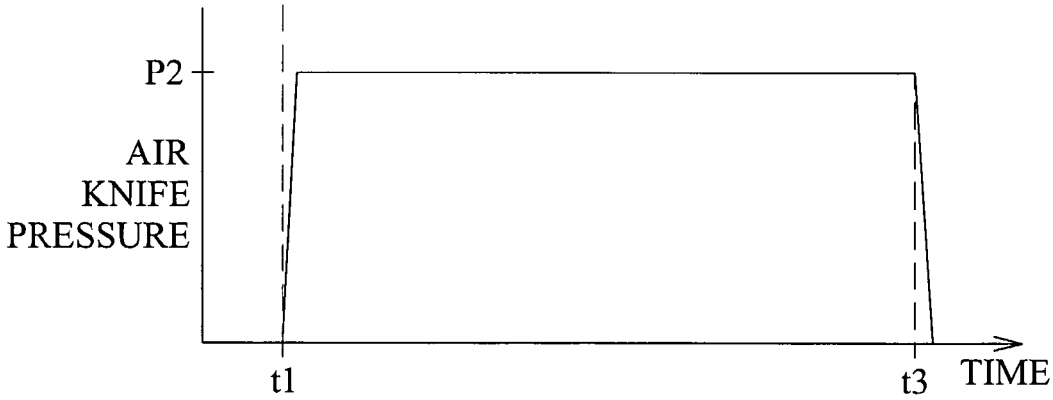
FIG. 4 illustrates the shape of the pressure pulse applied to the air knife in the first embodiment.

FIG. 4 shows a typical air knife pressure pulse, generated for example by the apparatus of FIG. 1. This pulse shape and duration corresponds to the pulse applied to the input of the passive valve. The pulse in FIG. 4 may thus be produced by controlling the single valve 14. The valve begins to open at t1, and begins to close at t3. Thus, when this relatively long pulse is supplied to the passive valve, the passive valve can automatically generate a shorter pulse.

For inkjet printer applications, typical values for t2-t1 are 20 ms, and typical values for t3-t1 are 250 ms. P1 will typically be in the range 0.2 to 0.5 bar (gauge pressure), and P2 will typically be in the range 0.2 to 3 bar (gauge pressure).

Referring now to FIG. 5, this shows, from above, part of an ink supply system for an inkjet printer. The system includes an ink refill container in the form of a rigid can 4, screwed into an angled socket provided on the ink reservoir housing. The housing comprises a top plate 139, over a block 136. An outlet 132 of a passive valve 13 is provided above the plate 139 and connects (by means not shown) to two, parallel air inlets 9, which communicate with a volume inside the housing, generally above the ink in the reservoir. FIG. 6 shows a cross section of the apparatus of FIG. 5, along line A-A. As can be seen, the connection of the container to the housing is such that the container body is inverted, and extends generally upwards from the ink reservoir. The ink reservoir contains a horizontal filter cloth 3, arranged to separate the reservoir into two volumes, V1 and V2. Ink supplied into volume V1 from container 4 flows down through the filter 3 into V2, from which it can then be supplied to a print head via ink outlet 1. The container comprises a resealable valve 41, which is opened when a threaded collar on the container is screwed into the threaded socket 42 on the housing. Ink can then be controllably driven into the reservoir, via tube 7, by repeated pressurisation and depressurisation of volume V1. The single block 136 comprises chambers which define the valve chamber 133 of passive valve 13, the lower chamber 23 of a diaphragm pump, and the lower portion of the ink reservoir. Sandwiched between the upper plate 139 and the lower block 136 is a gasket 200. This gasket is arranged to act as a baffle in the ink reservoir, and is provided with holes 201, offset from the inlets 9, which allow pressurised gas to be introduced into volume V1, but prevent the inflowing gas disturbing the ink surface. The gasket also provides the diaphragm 20 for the pump in this example. In other preferred embodiments the gasket and the diaphragm are separate components. For example, in one embodiment the diaphragm comprises elastomeric material and the baffle comprises a thin metal sheet. Returning to the embodiment of FIGS. 5 and 6, the upper chamber 22 of the pump is provided in the top plate 139. In this embodiment, non-return valves for the reclaim pump are also housed in the common, mono-block housing. The passive valve has the same general construction as that shown in FIG. 2, with a ball 134 deflectable upwardly in a chamber 133 to an o-ring 135 seat. Various materials such as rubber, elastomers and other resilient substances may be used for the gasket; the baffle may be a thin metal sheet.

Figure 7:
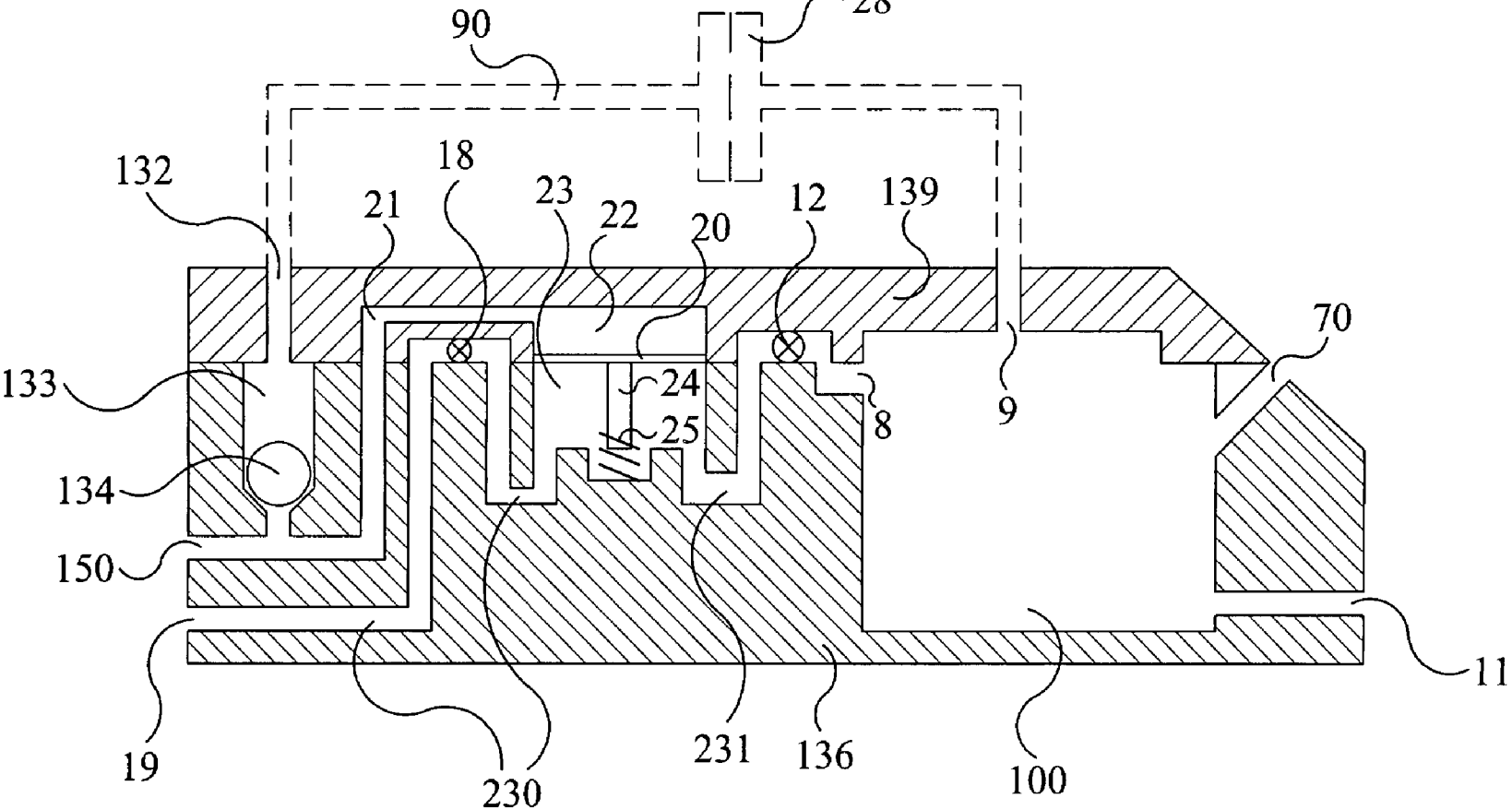
FIG. 7 is a schematic cross section of part of the ink supply system illustrated in FIGS. 5 and 6.

Referring now to FIG. 7, it can be seen that the ink supply system of this example comprises a main body member, in the form of block 136, and an auxiliary body member, head (or top plate) 139 mounted on the main body member to form an assembly. An ink reservoir cavity 100 and a pump cavity 22,23 are defined within the assembly. The pump cavity encloses a displaceable element, diaphragm 20, which divides the pump cavity into first 22 and second 23 chambers. The first chamber 22 is in communication with the ink reservoir cavity 100 and a pressurised gas inlet 150 via a first conduit, which includes passageway 21 inside the assembly, valve chamber 133, and an external conduit 90. The external conduit 90 includes a filter 28. It will be appreciated that, in alternative embodiments, the filter may be omitted and/or the conduit 90 may comprise further components, such as a branch and restrictor 16 as shown in FIG. 1. Returning to the present embodiment, the second chamber 23 is in communication with an ink inlet 19 via a second conduit 230 which includes a one-way valve 18 that prevents flow of ink from the second chamber to the ink inlet 19. The second chamber is also in communication with the ink reservoir cavity 100 via a third conduit 231 which includes a second one-way valve 12 that prevents flow of ink from the ink reservoir cavity to the second chamber. The displaceable diaphragm 20 is arranged such that pressurisation of the first conduit (by supplying gas at pressure to inlet 150) to pressurise the ink reservoir cavity (via passive valve chamber 133) also displaces the diaphragm (downwards) to pump ink from the second chamber to the ink reservoir cavity. The diaphragm is pushed down against a return member 24 and spring 25. In this example, the valve chamber 133 and lower chamber 23 of the pump are located in the lower portion (block) of the assembly), whilst the upper pump chamber is in the head 139. The non-return valves are housed in the assembly, as are the ink conduits 230 and 231. The number of external connections between component parts of the system is thus reduced. Ink supply into the reservoir from a refill container is by means of inlet 70.

Figure 8:
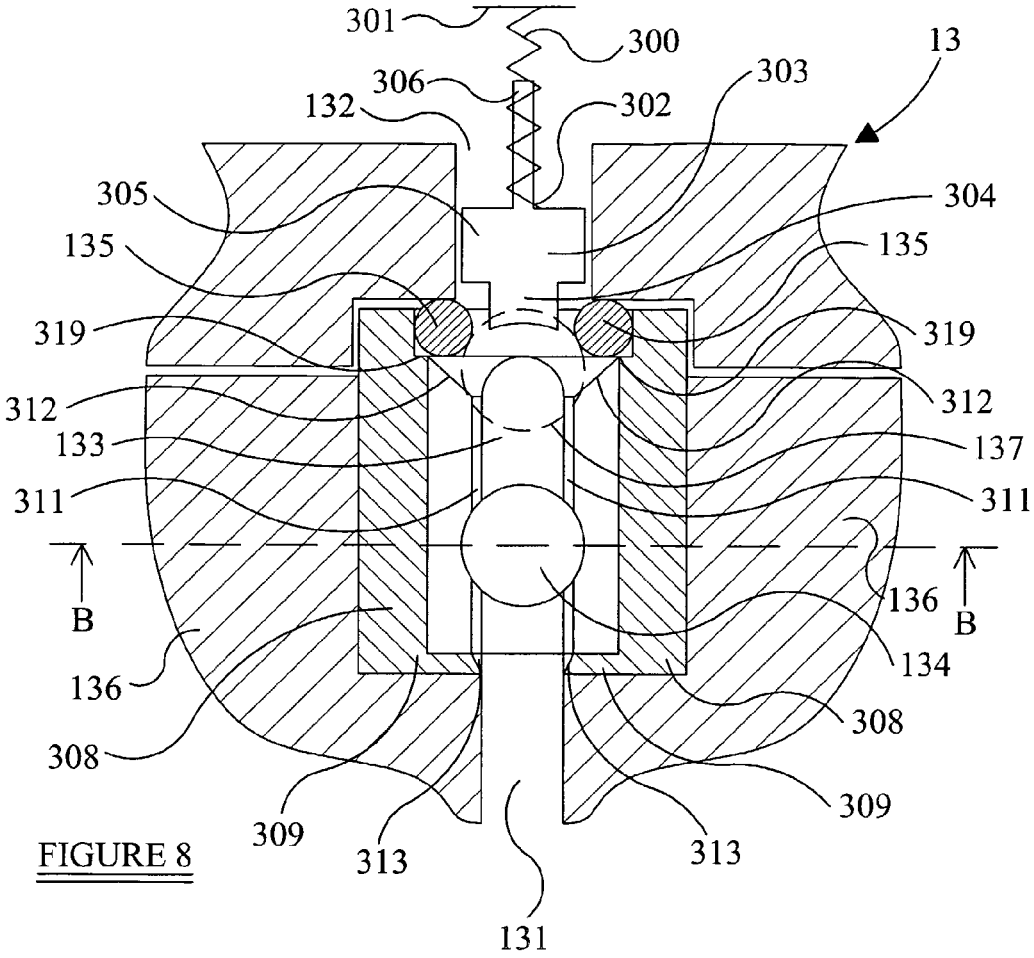
FIG. 8 is a schematic view, partly in cross section, of an alternative passive valve suitable for use in embodiments of the invention.

Referring now to FIG. 8, this shows a modification of the passive valve 13 of FIG. 2 suitable for use in embodiments of the present invention, and indeed suitable for use in the supply systems illustrated in FIGS. 1 and 7. Corresponding components depicted in FIGS. 2 and 8 are identified by the same reference numerals.

Return spring 300 in FIG. 2 is shown as ending freely within the valve chamber 133, at the lower end 302. However, it is desirable that the lower end 302 of the spring is not free to move laterally within the valve chamber 133.

In the valve depicted in FIG. 8, the lower end 302 of spring 300 engages a generally cross-shaped spring guide member 303 mounted above the o-ring 135. Spring guide 303 has a portion 304 extending into the centre of the o-ring 135 to engage the ball 134 when lifted to the second position 137 by the airflow. Portion 304 is shaped to engage the ball 134 with a curved section at its lower end. As spring 300 compresses and extends, portion 304 is constrained to move substantially along the bore of the valve, without significant lateral movement. Portion 305 (which is wider than portions 304 and 306) of spring guide 303 is located in the bore of the valve outlet 132, above the o-ring 135, and is sized such that it cannot pass through o-ring 135. As the spring 300 compresses and extends, the portion 305 slides axially up and down in the outlet bore. In this particular example, the upper end of the spring abuts a stop 301, but is not attached to the stop 301. Thus, a function of the spring guide 303 is that it prevents the spring 300 from dropping through the o ring 135 into the valve chamber 133. It will be appreciated, however, that in alternative embodiments the spring may be attached to the stop.

Spring guide 303 has an upper portion 306 comprising an upwardly extending protrusion through spring 300. Upper portion 306 is dimensioned such that the spring 300 fits loosely over it, so that the compression characteristics of the spring are not altered by the presence of the spring guide portion 306 inside it. In other words, in this example the spring does not grip the upper portion 306. It will be appreciated, however, that in alternative embodiments the spring guide 303 may be attached to the spring 300.

Figure 10:
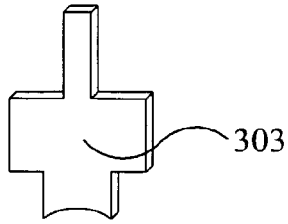
FIG. 10 illustrates detail of a spring guide suitable for use in the passive valve of FIG. 8.

The spring guide 303 of the valve of FIG. 8 is thus generally cruciform, as shown in detail in FIG. 10, which is a perspective view. In this embodiment, the spring guide 303 is formed from a thin sheet of material, namely 0.1 mm thick stainless steel. It will be appreciated, however, that in alternative embodiments the member 303 may have a different shape or thickness, and/or may be formed from other materials. The steel cross 303 is merely one example.

As with the spring 300 in FIG. 2, the spring guide 303 is arranged only to engage the ball 134 when the ball comes close to the o-ring 135, for instance within 1 mm of its "seated" position 137.

Figure 9:
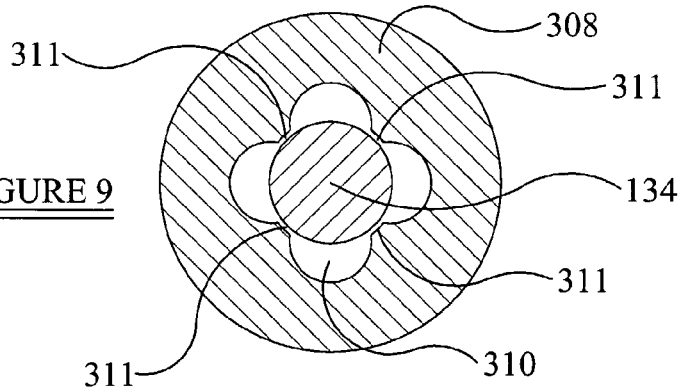
FIG. 9 is a cross section of part of the passive valve from FIG. 8, along line B-B.

A further difference between the passive valve 13 of FIG. 8 and that shown in FIG. 2 is that the FIG. 8 valve incorporates a valve chamber liner 308 inserted into the housing 136. As shown in FIG. 9, this valve liner 308 comprises a tube of material. FIG. 9 is a cross section of part of the valve 13 of FIG. 8 along the line B-B. At the lower end of the valve chamber 133 the valve liner extends inwardly at annular portion 309 about the gas inlet 131. The valve chamber liner 308 cross section and the ball cross section can be seen in FIG. 9. The valve chamber liner 308 has a bore, which comprises four lobes, the bore having a generally "cloverleaf" profile in this example. The four lobes 310 around ball 134 provide sufficient space between the ball 134 and the valve chamber liner 308 for air to pass. Longitudinal ribs 311, running parallel to the bore of valve chamber 133, are defined between the lobes 310, extend radially inwardly and are arranged to engage (i.e. guide) the ball 134 when the ball is moving between the first and second positions, thereby preventing ball 134 from excess lateral motion within valve chamber 133.

The upper end of valve chamber liner 308 comprises a chamfer 312. The bore of the liner also comprises an annular step 319 providing part of the seating for the o-ring 135. At the lower end of valve chamber liner 308 inwardly extending annular portion 309 has a chamfer 313 arranged to engage the ball 134 when it is in the first position at the base of valve chamber 133. Although not shown in the figure, the liner is adapted such that when the ball is in its lowest position, resting on chamfers 313, air is still able to flow up past the ball. This adaptation may take the form of one or more of the lobes 310 being continued through the annular flange 309 (i.e. a cut-out or slot).

Valve liner 308 serves to protect the housing 136 from damage that would otherwise be caused to a non-lined chamber by the repeated dropping and lateral rattling of ball 134. As such, valve liner 308 is formed from a hardwearing material able to withstand the repeated impact of ball 134. This may be a durable low wear, low friction plastics material such as, for example Delrin® manufactured by Dupont.

It will be appreciated from the above description that embodiments of the invention may provide a system which transfers ink from a removable ink container into an ink tank (reservoir) for use in a print head, to replenish the ink tank.

The tank can be connected to the container by connection means which, in certain embodiments may comprise a small bore tube or needle, which either pierces a membrane on the container or presses and opens a small valve on the container, thus producing a sealed conduit for fluid transfer between the two. The container may be an inverted bottle or aerosol-type can (unpressurised). If the ink tank is connected to atmosphere, and depending on the connecting means, ink may stay in the upturned container, i.e. it may not flow into the tank because of surface tension. However, embodiments of the invention may use a simple air valve to supply a small amount of compressed air into the tank (to raise its pressure to, say, between 0.25 and 1 bar), and then may exhaust the tank to atmospheric pressure. The pressurisation of the tank forces gas up through the connecting means, and into the ink in the upturned container (e.g. bottle). The gas bubbles up through the ink and occupies the air space at the "top" of the upturned bottle. When the tank is depressurised, the contained air in the bottle expands and pushes ink down through the connection means.

Thus, embodiments of the invention can provide a controllable means of transferring ink from a bottle to a tank, the amount of ink transferred being controlled by the pressure and volume of the gas delivered into the tank.

A single long (e.g. 250 ms) compressed air pulse can be generated and used to power an air knife cleaning system, power a reclaim pump, generate a short (e.g. 20 ms) purge pulse, feed ink from an ink supply can, and control the level of ink in the reservoir. The reservoir may be housed in a block, which may also contain a baffle to soften the purge pulse. The block may house other devices, such as diaphragm pumps and valves. The ink refill container may attach directly to the block. This saves space, reduces the amount of fluid piping and ink connections, and so reduces the number of potential leak points.

Using pressure pulses to drive diaphragm reclaim pumps and to supply ink from refill containers provides the advantage that reliability problems associated with motorised and/or solenoid pumps reclaim and supply pumps are avoided.

The invention claimed is:

1. A liquid supply system comprising: a liquid reservoir; a liquid container for supplying liquid to the reservoir; a connection means connecting the reservoir to a position within the container that is immersed in the contained liquid; and means for alternately pressurizing and depressurizing the reservoir, the arrangement being such that when the reservoir is pressurized gas is forced into the container through the connection means and accumulates above the liquid in the container, and such that when the reservoir is depressurized accumulated gas in the container forces liquid through the connection means to the reservoir.

2. A system in accordance with claim 1, arranged such that gravity urges contained liquid to flow from the container to the reservoir, the connection means comprising inhibiting means arranged to inhibit gravity feed of the reservoir with liquid from the container.

3. A system in accordance with claim 1, wherein the connection means comprises a conduit.

4. A system in accordance with claim 3, wherein the conduit is arranged to extend to the reservoir from said immersed position.

5. A system in accordance with claim 1, wherein the connection means comprises valve means.

6. A system in accordance with claim 1, wherein the connection means comprises a tube having a bore dimensioned such that surface tension of the liquid inhibits flow of the liquid through the bore.

7. A system in accordance with claim 1, wherein the container is substantially rigid and contains a volume of gas above the contained liquid, whereby pressurization of the reservoir increases the gas pressure in the container.

8. A system in accordance with claim 1, wherein the container comprises resealable valve means adapted to reseal the container when it is disconnected from the reservoir.

9. A system in accordance with claim 8, wherein the resealable valve means comprises a membrane, and the connection means comprises a needle adapted to pierce the membrane to connect the liquid inside the container to the reservoir.

10. A system in accordance with claim 8, wherein the resealable valve means comprises a valve member and biasing means biasing the member towards a valve seat.

11. A system in accordance with claim 1 and further comprising attachment means arranged to rigidly and releasably attach the container to a housing of the reservoir.

12. A system in accordance with claim 11, wherein the attachment means comprises a threaded neck on the container and a correspondingly threaded socket provided on the reservoir housing.

13. A system in accordance with claim 1 and further comprising a filter arranged inside the reservoir.

14. A system in accordance with claim 13, wherein the means for pressurizing and depressurizing is arranged to pressurize and depressurize a volume inside the reservoir and above the filter.

15. A system in accordance with claim 1, wherein the means for pressurizing and depressurizing comprises a compressed gas supply, a compressed gas conduit connecting the compressed gas supply to a compressed gas inlet of the reservoir, and control means arranged to control supply of the compressed gas from the supply into the reservoir.

16. A system in accordance with claim 15, wherein the control means is adapted to supply pressure pulses to the reservoir.

17. A system in accordance with claim 16, wherein the pressure pulses are arranged to have relatively rapidly rising leading edges and relatively slowly falling trailing edges.

18. A system in accordance with claim 15, wherein the control means comprises a controllable valve.

19. A system in accordance with claim 18, wherein the control means further comprises a passive valve arranged downstream of the controllable valve, the passive valve being adapted to initially allow gas flow towards the reservoir when an inlet of the passive valve is exposed to pressurised gas from the supply as a result of the controllable valve being opened, and then to close automatically after a period of time in response to continued exposure, to prevent further flow, and to remain closed until the pressure at the inlet to the passive valve drops below a predetermined threshold, whereby pressurized gas is supplied to the reservoir via the controlled and passive valves.

20. A system in accordance with claim 19, wherein the passive valve comprises a valve member biased towards a first position in which gas flow through the passive valve is permitted, the valve member being deflectable when exposed to the pressurized gas from the supply, as a result of the initial pressurized gas flow, to a second position in which it engages a valve seat and prevents further gas flow, continued exposure to the supply maintaining the valve member against the seat, the time taken to deflect the valve member from the first to the second position determining said period of time, and hence the length of a pressure pulse transmitted by the passive valve.

21. A system in accordance with claim 20, wherein the valve member comprises a ball, biased under gravity to sit in a first position in a valve chamber, the passive valve inlet being arranged to direct supplied pressurized gas up into the chamber, initially to flow past the ball, the ball being arranged so as to be lifted by the gas flow to a second position in which it is brought into sealing engagement with a valve seat and closes the passive valve.

22. A system in accordance with claim 19, comprising at least one device having a compressed gas inlet connected so as to be supplied with compressed gas extracted from the compressed gas conduit at a position downstream of the controllable valve and upstream of the passive valve.

23. A system in accordance with claim 22, wherein the at least one device comprises a pump.

24. A system in accordance with claim 23, wherein the pump is a diaphragm pump.

25. A system in accordance with claim 22, wherein the at least one device comprises an air knife or air curtain generator.

26. A system in accordance with claim 1, wherein the means for pressurizing and depressurizing comprises a gas exhaust conduit connecting a gas outlet of the reservoir to atmosphere, the gas exhaust conduit comprising restriction means arranged to restrict flow of gas from the reservoir to atmosphere.

27. A system in accordance with claim 26, wherein the restriction means is adjustable.

28. A system in accordance with claim 26, as depending from claim 15, wherein the gas outlet of the reservoir is provided by the gas inlet, and the gas exhaust conduit comprises a portion of the compressed gas conduit and a branch off the compressed gas conduit, the restriction means being located on said branch.

29. A system in accordance with claim 28, wherein said branch branches from the compressed gas conduit at a position downstream of the passive valve.

30. A system in accordance with claim 1 wherein the system is adapted for an inkjet printer, the liquid container containing a quantity of ink, and the reservoir being an ink reservoir adapted to supply ink to a print head.

31. A system in accordance with claim 30, wherein the liquid container is an ink refill container.

32. A system in accordance with claim 30, arranged such that when the reservoir is pressurized to force gas into the container, pressure is applied to a surface of ink in the reservoir to force ink to the print head.

33. An inkjet printer comprising: a print head having at least one orifice from which a jet of ink can be ejected; and a liquid supply system comprising a liquid reservoir; a liquid container for supplying liquid to the reservoir; a connection means connecting the reservoir to a position within the container that is immersed in the contained liquid; and means for alternately pressurizing and depressurizing the reservoir, the arrangement being such that when the reservoir is pressurized gas is forced into the container through the connection means and accumulates above the liquid in the container, and such that when the reservoir is depressurized accumulated gas in the container forces liquid through the connection means to the reservoir, the liquid container being an ink container, and the reservoir being an ink reservoir arranged to supply ink to the print head.

34. An inkjet printer in accordance with claim 33, the liquid supply system being arranged such that when the reservoir is pressurized to force gas into the container, pressure is applied to ink in the reservoir to force ink to the print head and purge the at least one orifice.

35. An inkjet printer in accordance with claim 33, wherein the means for pressurizing and depressurizing is arranged to supply pressure pulses to the reservoir, the pressure pulses being arranged to simultaneously force gas into the ink container and force ink to the print head to purge the at least one orifice.

36. An inkjet printer in accordance with claim 33, wherein the pump comprises a pump arranged to pump ink.

37. An inkjet printer in accordance with claim 33, wherein the air knife or air curtain generator is arranged to direct a curtain of gas across a surface of the print head, over the at least one orifice.

38. An ink container for use with an inkjet printer in accordance with claim 33, the container being sealed and containing a quantity of ink and a volume of gas, the gas being at a pressure, when the container is sealed, less than atmospheric pressure.

* * * * *